US007661482B2

(12) United States Patent
Whitney, Sr.

(10) Patent No.: US 7,661,482 B2
(45) Date of Patent: Feb. 16, 2010

(54) TREE FIRE EXTINGUISHING DEVICE

(76) Inventor: Sterling Whitney, Sr., 6218 Limekiln Pike, Philadelphia, PA (US) 19141

( * ) Notice: Subject to any disclaimer, the term of this patent is extended or adjusted under 35 U.S.C. 154(b) by 162 days.

(21) Appl. No.: 11/832,664

(22) Filed: Aug. 2, 2007

(65) Prior Publication Data

US 2009/0032271 A1 Feb. 5, 2009

(51) Int. Cl.

| | |
|---|---|
| ***A62C 3/00*** | (2006.01) |
| ***A62C 35/02*** | (2006.01) |
| ***A62C 35/13*** | (2006.01) |
| ***A62C 35/00*** | (2006.01) |
| ***A62C 37/08*** | (2006.01) |
| ***B05B 9/04*** | (2006.01) |

(52) U.S. Cl. ..... 169/26; 169/9; 169/54; 169/56; 239/74; 239/373; 239/567

(58) Field of Classification Search ..... 169/9, 169/26, 30, 42, 54, 56, 57, 60, 72, 74, 76, 169/85, 89

See application file for complete search history.

(56) References Cited

U.S. PATENT DOCUMENTS

| | | | | |
|---|---|---|---|---|
| 2,522,020 A | | 9/1950 | Deyo | |
| 2,871,952 A | * | 2/1959 | Doak | 169/26 |
| 2,876,845 A | | 3/1959 | Boyce | |
| 3,773,111 A | | 11/1973 | Dunn | |
| 3,800,878 A | * | 4/1974 | Poitras | 169/20 |
| 5,018,586 A | | 5/1991 | Cawley et al. | |
| 5,031,702 A | | 7/1991 | Trumbach | |
| D352,366 S | | 11/1994 | Cox | |
| 5,458,201 A | * | 10/1995 | Brim | 169/26 |
| 5,785,127 A | * | 7/1998 | Miller, Sr. | 169/71 |
| 6,003,610 A | | 12/1999 | Kordes | |
| 6,382,582 B1 | | 5/2002 | Brown | |
| 7,044,404 B1 | * | 5/2006 | Kricheldorf | 239/525 |
| 2006/0131035 A1 | * | 6/2006 | French | 169/37 |

* cited by examiner

*Primary Examiner*—Darren W Gorman
(74) *Attorney, Agent, or Firm*—Dovas Law, P.C.

(57) ABSTRACT

The present invention provides a tree fire extinguishing device including an upright standing hollow body. An air compressor pump is connected to the hollow body for providing pressurized air to the hollow body. At least one heat activated fluid release valve is connected to the hollow body. The present invention further provides a method of configuring a tree display.

16 Claims, 5 Drawing Sheets

TREE FIRE EXTINGUISHING DEVICE

BACKGROUND

Each year, hundreds of trees used in the celebration of holidays catch fire causing property damage and in some cases injury and loss of life. The ubiquitous "Christmas" tree, typically an evergreen such as a Douglas Fir, Blue Spruce, and Norway spruce, is often laden with decorations including electric lights as part of yearly Christmas festivities in the United States and other countries. Such lights often generate significant amounts of heat resulting in fire risk. A fire started on a portion of the tree may quickly consume the entire tree and spread to surrounding furnishings or building structure. Even in the case where a fire in a tree is quickly extinguished, significant damage to surrounding building structure and furnishings may occur.

It would be desirable to provide a device which would be effective in preventing the spread of a fire started in a tree within a building, protecting surrounding building structure and furnishings, and quickly extinguishing the fire.

SUMMARY

The present invention provides a tree fire extinguishing device including an upright standing hollow body. An air compressor pump is connected to the hollow body for providing pressurized air to the hollow body. At least one heat activated fluid release valve is connected to the hollow body.

The present invention further provides a method of configuring a tree display. The method includes providing a tree fire extinguishing device including an upright standing substantially air-tight hollow body and a heat activated fluid release valve connected to the hollow body. A tree with a plurality of branches is provided. A fire extinguishing fluid is added to the upright standing substantially air-tight hollow body. An air space within the upright standing substantially air-tight hollow body is pressurized. The tree is positioned adjacent to the tree fire extinguishing device within a discharge area of the heat activated fluid release valve.

The present invention further provides a tree fire extinguishing device including an upright standing arcing hollow body comprising an inwardly curving surface. An air compressor pump is connected to the hollow body for providing pressurized air to the hollow body. A plurality of heat activated fluid release valves are connected to and extend from the inwardly curving surface of the hollow body Each of the plurality of heat activated fluid release valves comprise a fire sprinkler head comprising a trigger mechanism and a deflector head.

BRIEF DESCRIPTION OF THE DRAWING(S)

The foregoing Summary as well as the following detailed description will be readily understood in conjunction with the appended drawings which illustrate preferred embodiments of the invention. In the drawings.

DETAILED DESCRIPTION OF THE PREFERRED EMBODIMENT(S)

Figure 1:
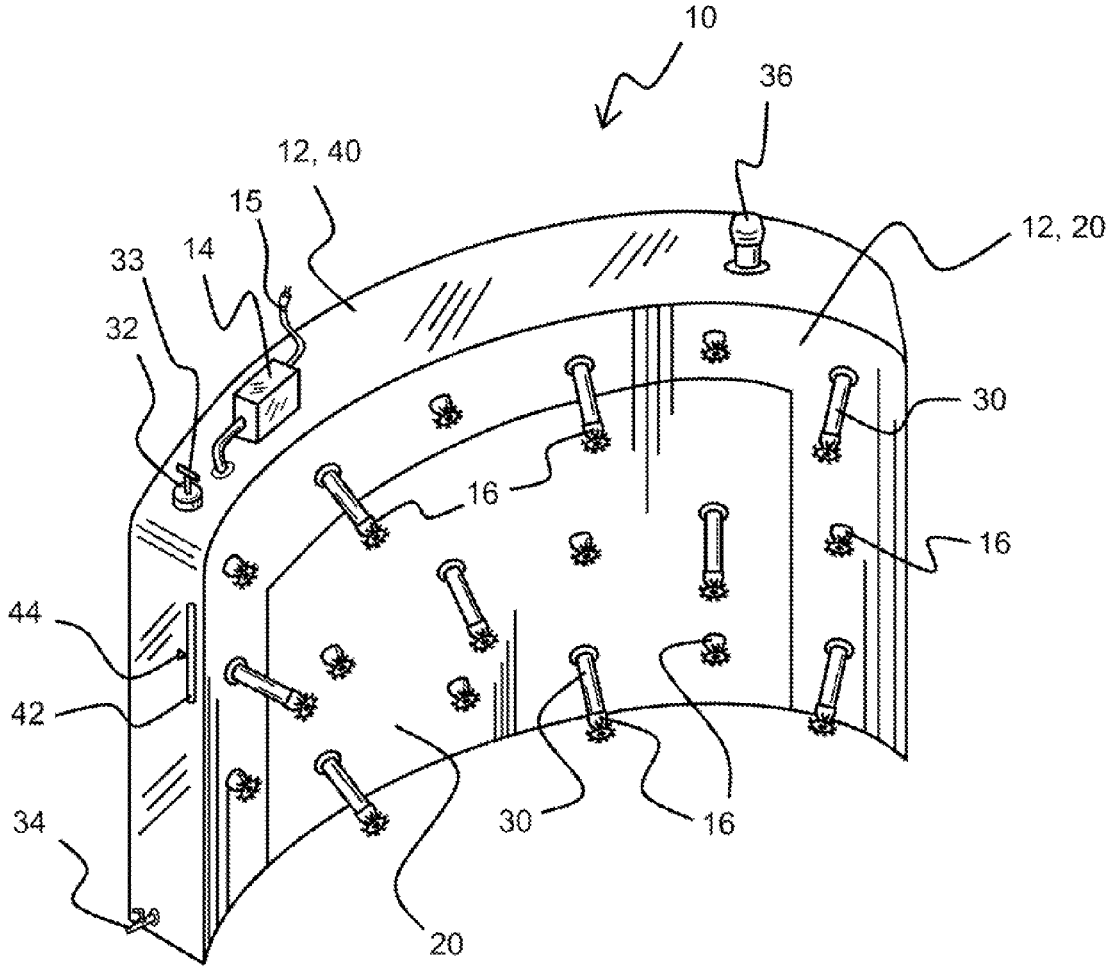
FIG. 1 is a top perspective view of a tree fire extinguishing device according to a preferred embodiment of the present invention.
Figure 2:
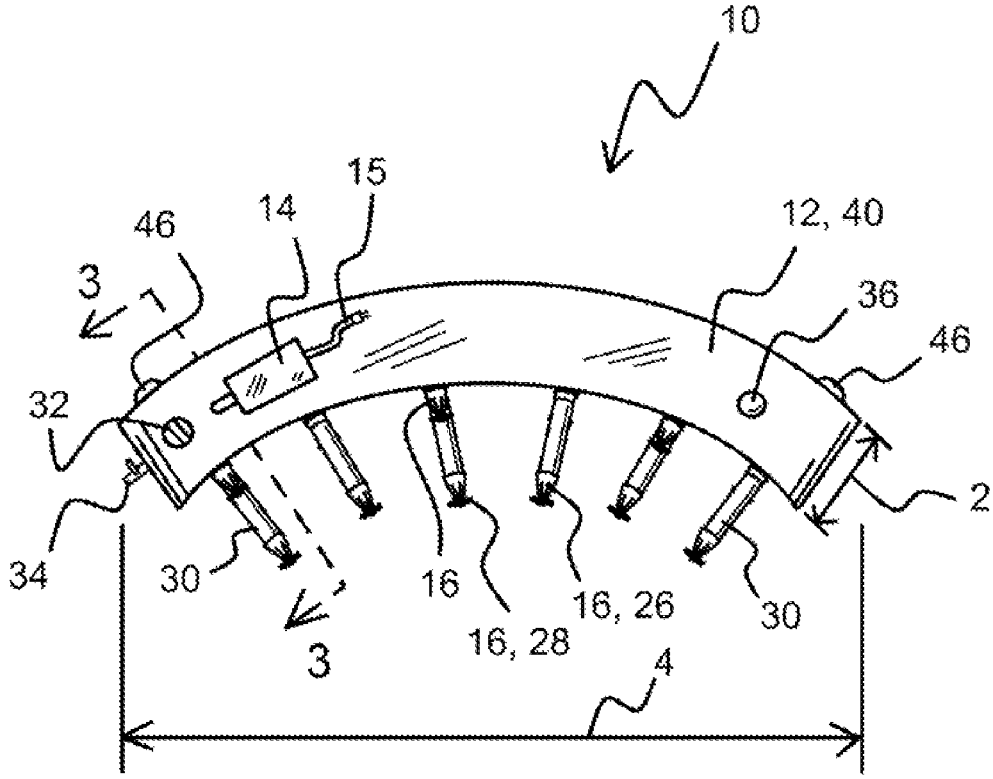
FIG. 2 is a top view of the tree fire extinguishing device of FIG. 1.
Figure 3:
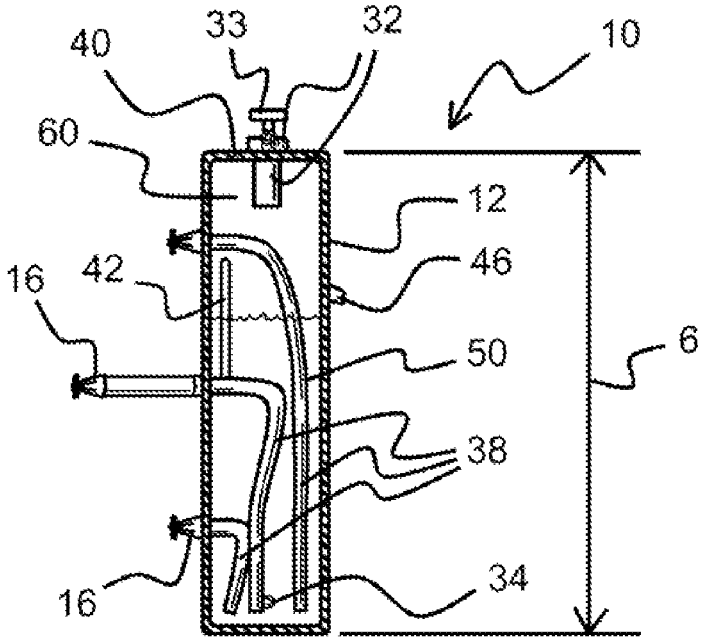
FIG. 3 is a cross-section view of the tree fire extinguishing device of FIG. 1 taken along line 3-3 in FIG. 2.

Certain terminology is used in the following description for convenience only and is not limiting. The words "right," "left," "top," and "bottom" designate directions in the drawings to which reference is made. The words "a" and "one" are defined as including one or more of the referenced item unless specifically stated otherwise. This terminology includes the words above specifically mentioned, derivatives thereof, and words of similar import. The phrase "at least one" followed by a list of two or more items, such as A, B, or C, means any individual one of A, B or C as well as any combination thereof.

The preferred embodiments of the present invention are described below with reference to the drawing figures where like numerals represent like elements throughout.

Referring to FIGS. 1-4, a tree fire extinguishing device 10 according to a preferred embodiment of the present invention is shown. The tree fire extinguishing device 10 includes an upright standing hollow body 12, an air compressor pump 14 connected to the hollow body 12 for providing pressurized air to the hollow body 12, and a plurality of heat activated fluid release valves 16 connected to the hollow body 12.

The upright standing hollow body 12 preferably includes a substantially air-tight body having a height 6 of at least three (3) times a depth 2 and having a width 4 of at least three (3) times the depth 2. The hollow body 12 has a low profile arcing form, as shown, with an inwardly curving surface 20, which enables it to maintain a stable upright position.

Preferably the hollow body 12 has a depth 2 of at least 12 cm, a width 4 of at least 1 meter and a height 6 of at least 1 meter. More preferably, the hollow body 12 has a depth 2 of at least 25 cm, a width 4 of at least 1.5 meters and a height 6 of at least 1.2 meters. Most preferably, the hollow body 12 has a depth 2 of about 30 cm, a width 4 of about 1.8 meters and a height 6 of about 1.4 meters. Alternatively, the hollow body 12 may be formed in any size suitable for a particular application. Further, supports may alternatively be provided external to the hollow body 12 to stabilize the hollow body 12 in its upright position. Moreover, the hollow body 12 may alternatively be formed flat instead of arcing, or alternatively formed in any suitable manner.

The hollow body 12 preferably comprises a fire resistant polymeric material having a material thickness of at least 3 millimeters. The hollow body 12 is preferably configured to maintain an internal gauge pressure of at least 2.7 bar (39 psig) without failure. Handles 46 are preferably provided integral with or attached to the hollow body 12 to facilitate handling of the tree fire extinguishing device 10.

The heat activated fluid release valves 16 preferably include fire sprinkler heads having a heat activated trigger mechanism 26 and a deflector head 28. Preferably, National Fire Protection Association (NFPA) standard fire sprinkler heads are used, having glass tube or releasable solder plate trigger mechanisms. Alternatively, any suitable heat activated fluid release valves using any suitable heat detection device may be used. The plurality of heat activated fluid release valves 16 are connected to the inwardly curving surface 20 of the hollow body 12 for dispersing a fire extinguishing fluid 50 from the interior of the hollow body 12. Preferably, the heat activated fluid release valves 16 are substantially evenly distributed on the curving surface 20. While eighteen heat activated fluid release valves 16 are shown, alternatively, any suitable number of heat activated fluid release valves 16 may be provided in any suitable distribution.

At least some of the heat activated fluid release valves 16 are connected to extenders 30 which are conduits allowing the release valves 16 to be positioned at a distance from the hollow body 12. The extenders 30 are preferably steel. Alternatively, the extenders 30 can be formed of any suitable material.

Tubes 38 within the hollow body 12 are connected to the release valves 16 and extend to a bottom portion of the hollow body 12 within the hollow body 12 for transporting the fire extinguishing fluid 50 from the hollow body 12 to the release valves 16. The tubes 38 are preferably flexible polymeric tubes. While a single one of the tubes 38 is shown connected to each of the release valves 16 and extending to the bottom portion of the hollow body 12, one skilled in the art will recognize that two or more of the release valves 16 may share a single tube, for example using a T or Y connector. Alternatively, any suitable manner of connecting tubes to the release valves 16 may be implemented for drawing fluid from the hollow body 12.

A closeable aperture on the hollow body 12 includes a removable cap 32 for adding or removing fluid 50 to the hollow body 12. The removable cap is preferably a screw cap including an auxiliary air pump which may be manually actuated by pushing and retracting a pump handle 33 attached thereto. During use of the tree fire extinguishing device 10, the fire extinguishing fluid 50 may be added to the hollow body 12 by removing the cap 32. The removable cap 32 provides a substantially air-tight closure when attached to the hollow body 12. A fill and drain valve 34 is also preferably provided which permits fluid to be added or drained through connection of a fluid supply line. The fill and drain valve 34 may be any suitable valve, for example a typical residential garden hose valve. The preferred fire extinguishing fluid 50 for use with the tree fire extinguishing device 10 is water. Alternatively, any suitable fire extinguishing fluid can be used.

The air compressor pump 14 is preferably electrically powered and includes an electric power cord 15. The air compressor pump 14 may include a reservoir tank for holding compressed air or be provided without a reservoir tank. Alternatively, a manual air compressor pump may be provided, for example a hand-operated air compressor pump. The air compressor pump 14 is preferably configured to pressurize an air space 60 between the fire extinguishing fluid 50 and a top portion 40 of the hollow body. The air compressor pump 14 is preferably configured to pressurize the air space 60 to a gauge pressure between about 0.7 bar (10 psig) and 2.0 bar (29 psig). Alternatively, the air compressor pump 14 can be configured to provide any suitable air pressure within the air space 60. A pressure release valve 36 is preferably provided to permit the release of air if air pressure exceeds a predetermined limit. When one or more of the release valves 16 are triggered by a rise in heat, the fire extinguishing fluid 50 is forced by the compressed air through the tubes 38 into the one or more triggered release valves 16 and out of the tree fire extinguishing device 10 into a discharge area.

A view window 42 is preferably provided to permit a user to see a level of the fire extinguishing fluid 50 in the hollow body 12. An indicia 44 is provided adjacent to, or alternatively, integral with the view window 42 to indicate to a user a maximum predetermined fluid fill level. The predetermined maximum fluid fill level is selected such that a sufficient volume of compressed air is present in the air space 60 between the fire extinguishing fluid 50 and the top portion 40 of the hollow body 12 to allow an adequate amount of fire extinguishing fluid 50 at sufficient force to be released in the event of a fire.

Figure 4:
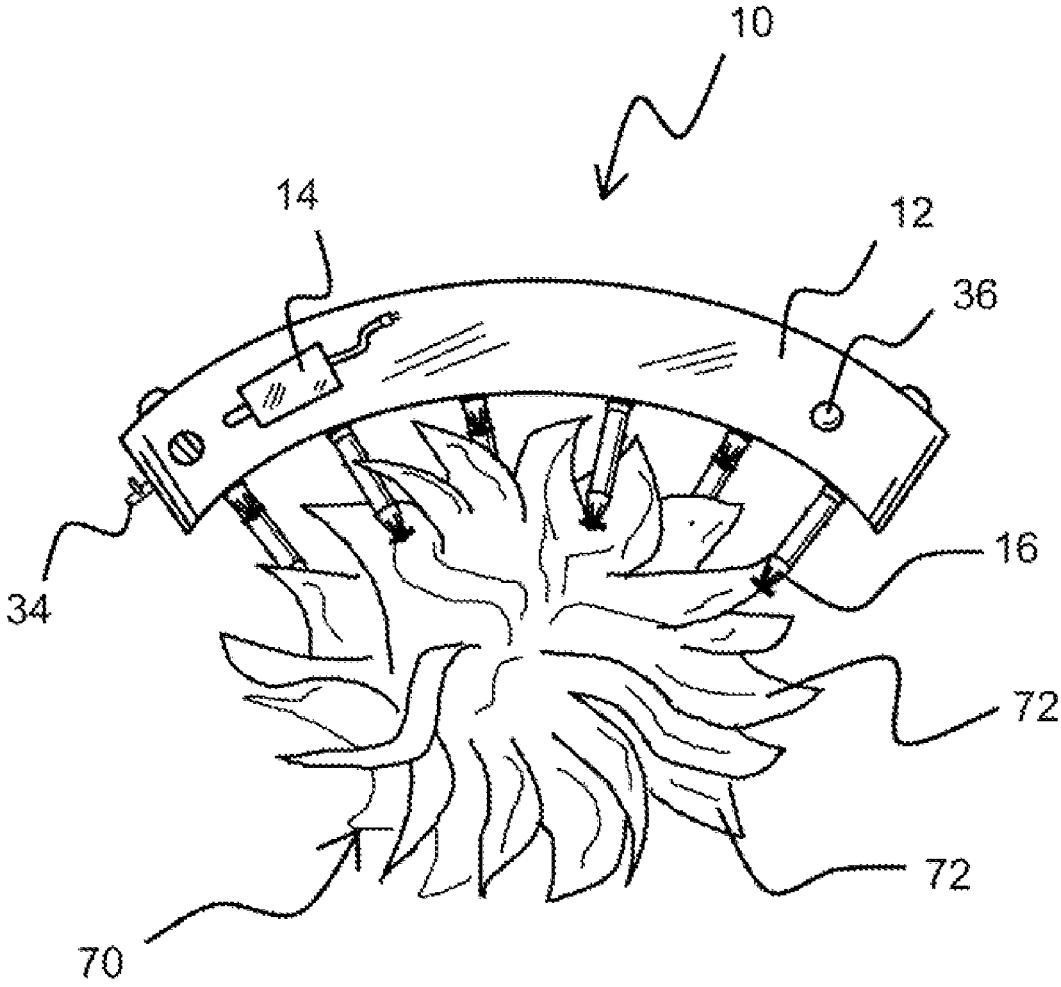
FIG. 4 is a top view of the tree fire extinguishing device of FIG. 1, shown used in a preferred manner with a tree positioned adjacent thereto.

Referring to FIG. 4, a tree 70 having a plurality of branches 72 is shown positioned in a preferred manner next to the tree fire extinguishing device 10 in a discharge area of the fire extinguishing device 10. As shown, some of the fluid release valves 16 extend into an area defined by the ends of the plurality of branches 72 potentially allowing for better heat sensing and fire extinguishing effectiveness. Alternatively, the tree 70 may be removed a distance from the tree fire extinguishing device 10.

In the event of a fire, the hollow body 12 filled with the fire extinguishing fluid 50 may act to prevent surrounding structure or furnishings from heat and fire damage, and one or more of the fluid release valves 16 may be activated by the heat of the fire thereby dispersing fluid on the tree and extinguishing the flames. While not wishing to be limited by any particular theory of functionality, the hollow body 12 by virtue of being filled with the fire extinguishing fluid 50 will potentially rise in temperature at a slower rate than building furnishings or structures during a fire event. Moreover, the arcing form of the hollow body 12 is capable of surrounding a significant portion of a tree to potentially contain heat and flames and protect surrounding structure or furnishings.

Figure 5:
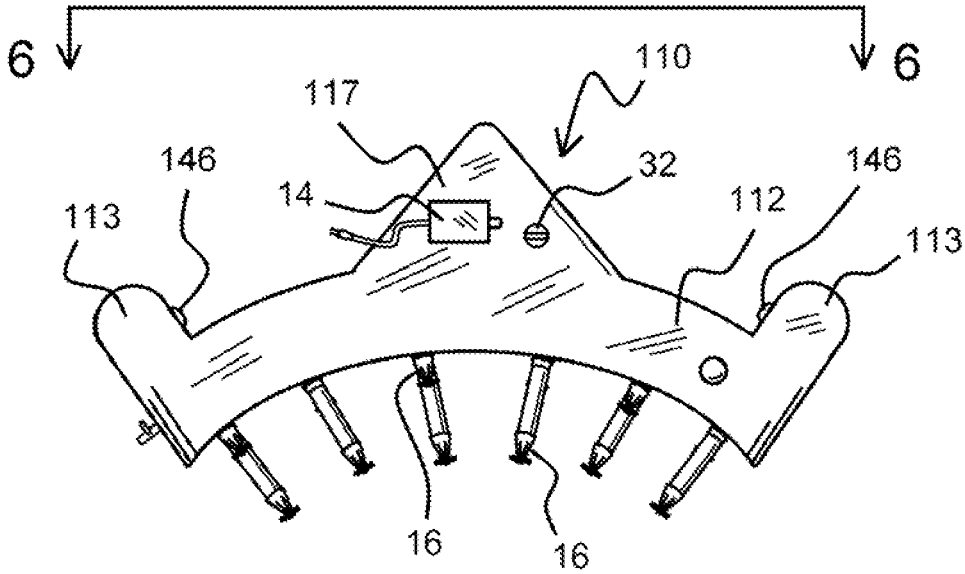
FIG. 5 is a top view of a tree fire extinguishing device according to another preferred embodiment of the present invention.
Figure 6:
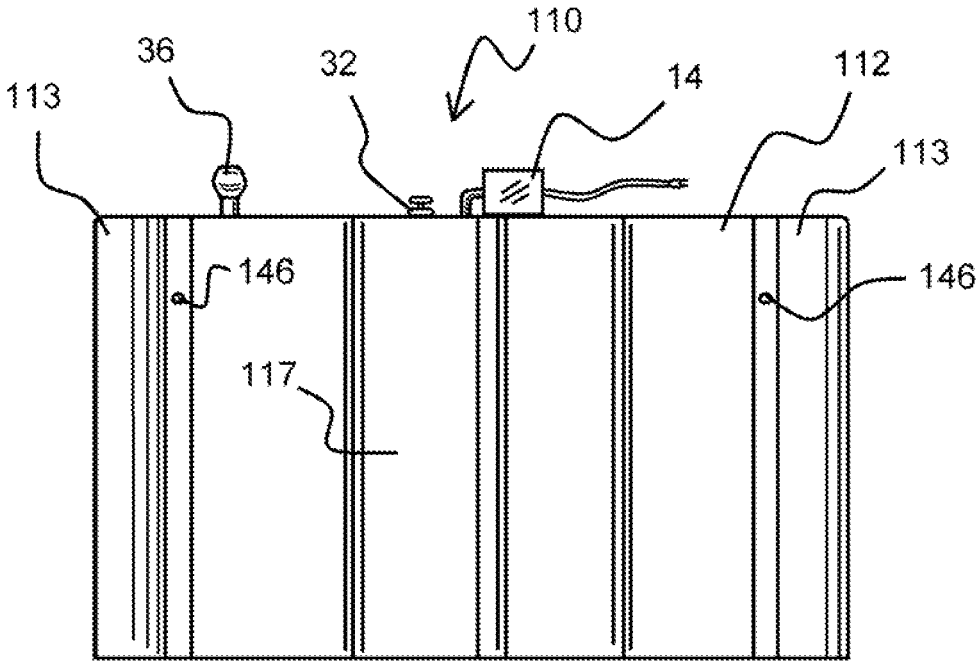
FIG. 6 is rear elevation view of the tree fire extinguishing device of FIG. 5 taken along line 6-6 in FIG. 5.

Referring to FIGS. 5 and 6, a tree fire extinguishing device 110 according to another preferred embodiment of the present invention is shown. The tree fire extinguishing device 110 is similar in operation to the tree fire extinguishing device 10 set forth above, but includes a hollow body 112 having additional capacity portions 113, 117. The portions 113, 117 are in fluid connection with the remaining portion of the hollow body 112 and serve to increase the volume of fire extinguishing fluid 50 and compressed air which can be stored by the hollow body 112. Moreover the portions 113, 117 provide additional stability to the extinguishing device 110. Handles 146 are provided to facilitate handling of the tree fire extinguishing device 110.

Figure 7:
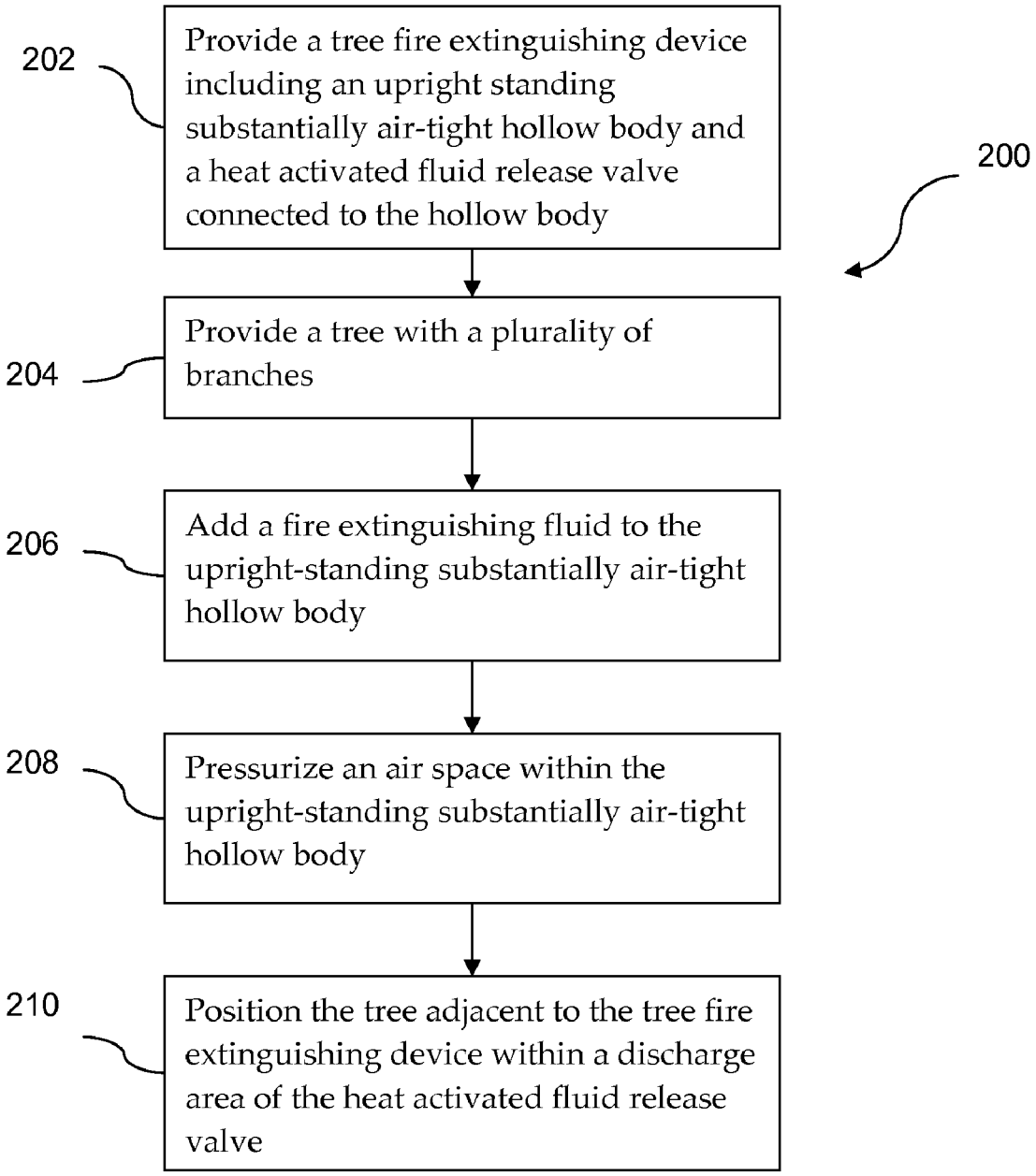
FIG. 7 is a flowchart diagram showing a method of configuring a tree display according to a preferred embodiment of the present invention.

Referring to FIG. 7, a flow chart diagram of a method 200 of configuring a tree display is shown. The method 200 includes providing a tree fire extinguishing device including an upright standing substantially air-tight hollow body and a heat activated fluid release valve connected to the hollow body (step 202). A tree with a plurality of branches is provided (step 204). A fire extinguishing fluid is added to the upright standing substantially air-tight hollow body (step 206). An air space within the upright standing substantially air-tight hollow body is pressurized (step 208). The tree is positioned adjacent to the tree fire extinguishing device within a discharge area of the heat activated fluid release valve (step 210).

While the preferred embodiments of the invention have been described in detail above, the invention is not limited to the specific embodiments described above, which should be considered as merely exemplary. Further modifications and extensions of the present invention may be developed, and all such modifications are deemed to be within the scope of the present invention as defined by the appended claims.

What is claimed is:

1. A tree fire extinguishing device comprising:

an upright standing hollow body comprising an inwardly curving surface which defines a discharge area at least partially surrounded by the inwardly curving surface, whereby a tree placed in the discharge area is at least partially surrounded by the inwardly curving surface;

an air compressor pump connected to the hollow body for providing pressurized air to the hollow body; and a plurality of heat activated fluid release valves connected to and extending from the inwardly curving surface into the discharge area.

2. The tree fire extinguishing device of claim 1, wherein the upright standing hollow body comprises a substantially airtight body having a height at least three (3) times its depth and having a width at least three (3) times its depth.

3. The tree fire extinguishing device of claim 1, wherein the upright standing hollow body comprises a low profile arcing body.

4. The tree fire extinguishing device of claim 1, wherein the upright standing hollow body comprises a fire resistant polymeric material.

5. The tree fire extinguishing device of claim 1, wherein each of the heat activated fluid release valves comprises at least one fire sprinkler head comprising a heat activated trigger mechanism and a deflector head.

6. The tree fire extinguishing device of claim 1, further comprising at least one extender which connects at least one of the heat activated fluid release valves to the hollow body.

7. The tree fire extinguishing device of claim 1, further comprising at least one tube connected to each of the heat activated fluid release valves and positioned within the hollow body, the at least one tube extending from each of the heat activated fluid release valves toward a bottom portion of the hollow body.

8. The tree fire extinguishing device of claim 1, further comprising at least one closeable aperture on the hollow body for adding or removing fluid to the hollow body.

9. The tree fire extinguishing device of claim 1, further comprising a pressure relief valve connected to the hollow body.

10. The tree fire extinguishing device of claim 1, further comprising a view window connected to the hollow body.

11. The tree fire extinguishing device of claim 1, wherein the upright standing hollow body comprises a low profile body comprising the inwardly curving surface, and wherein the upright standing hollow body comprises a depth of at least 12 cm, a width of at least 1 meter, and a height of at least 1 meter.

12. The tree fire extinguishing device of claim 1, wherein the upright standing hollow body comprises a low profile body comprising the inwardly curving surface, and wherein the upright standing hollow body comprises a depth of at least 12 cm, a width of at least 1 meter, and a height of at least 1 meter, and wherein the heat activated fluid release valves comprise a plurality of fire sprinkler heads, each fire sprinkler head comprising a trigger mechanism and a deflector head, connected to the inwardly curving surface of the low profile body, the tree fire extinguishing device further comprising at least one extender which connects at least one of the plurality of fire sprinkler heads to the inwardly curving surface of the low profile body.

13. The tree fire extinguishing device of claim 1, wherein the at least one air compressor pump is electrically powered.

14. A tree fire extinguishing device comprising:

an upright standing arcing hollow body comprising an inwardly curving surface which defines a discharge area at least partially surrounded by the inwardly curving surface, whereby a tree placed in the discharge area is at least partially surrounded by the inwardly curving surface;

an air compressor pump connected to the hollow body for providing pressurized air to the hollow body; and a plurality of heat activated fluid release valves connected to and extending from the inwardly curving surface of the hollow body into the discharge area, each of the plurality of heat activated fluid release valves comprising a fire sprinkler head comprising a trigger mechanism and a deflector head.

15. The tree fire extinguishing device of claim 14, further comprising a fill and drain valve connected to the hollow body.

16. A tree fire extinguishing device comprising:

an upright standing arcing hollow body comprising a concave surface which defines a discharge area at least partially surrounded by the concave surface, whereby a tree placed in the discharge area is at least partially surrounded by the concave surface;

an air compressor pump connected to the hollow body for providing pressurized air to the hollow body; and at least one heat activated fluid release valve connected to and extending from the concave surface of the hollow body into the discharge area defined by the concave surface, wherein the at least one release valve is configured to discharge extinguishing fluid into the discharge area defined by the concave surface.

* * * * *